US005545798A

United States Patent [19]

Elliott

[11] Patent Number: 5,545,798

[45] Date of Patent: Aug. 13, 1996

[54] PREPARATION OF RADIOACTIVE ION-EXCHANGE RESIN FOR ITS STORAGE OR DISPOSAL

[76] Inventor: Guy R. B. Elliott, 4515 Stockbridge Ave., NW., Albuquerque, N.M. 87120-5407

[21] Appl. No.: 328,142

[22] Filed: Oct. 24, 1994

Related U.S. Application Data

[63] Continuation-in-part of Ser. No. 951,876, Sep. 28, 1992, abandoned.

[51] Int. Cl.[6] ..... G21F 9/00

[52] U.S. Cl. ..... 588/18; 588/20; 210/751; 976/DIG. 381; 976/DIG. 383; 976/DIG. 384

[58] Field of Search ..... 588/19, 20, 18; 210/682, 751; 976/DIG. 381, DIG. 383, DIG. 384

[56] References Cited

U.S. PATENT DOCUMENTS

| | | | |
|---|---|---|---|
| 4,122,048 | 10/1978 | Buchwalder et al. | 521/26 |
| 4,235,738 | 11/1980 | Knotik et al. | 252/301.1 W |
| 4,499,833 | 2/1985 | Grantham | 110/342 |
| 4,636,335 | 1/1987 | Kawamura et al. | 252/629 |
| 4,654,172 | 3/1987 | Matsuda et al. | 252/629 |
| 4,668,435 | 5/1987 | Grantham | 252/632 |
| 4,686,068 | 8/1987 | Saida et al. | 252/632 |
| 4,732,705 | 3/1988 | Laske et al. | 252/628 |
| 4,834,915 | 5/1989 | Magnin et al. | 252/628 |

*Primary Examiner*—Ngoclan Mai

[57] ABSTRACT

A practical method is described for preparation of radioactive ion-exchange resin for its disposal after the ion-exchange resin has become radioactive in the process of decontaminating radioactive water. Substantially nonradioactive material, which has been derived from the radioactive ion-exchange resin can be disposed of conventionally. The concentration allows corollary reduction of the volume of radioactive waste which must be handled in very costly ways. The radioactive ion-exchange resin and materials that react with the radioactive decaying atoms are heated under controlled atmospheres to (i) form nonvolatile chemicals that hold the decaying atoms, and (ii) under controlled conditions, depolymerize, vaporize, pyrolize, and otherwise decompose and remove nonradioactive components of the ion-exchange resin from the radioactive decaying atoms.

20 Claims, 3 Drawing Sheets

PREPARATION OF RADIOACTIVE ION-EXCHANGE RESIN FOR ITS STORAGE OR DISPOSAL

This APPLICATION IS A CONTINUATION-IN-PART OF application Ser. No. 07/951,876, filed Sep. 28, 1992 abandoned.

BACKGROUND OF THE INVENTION

1. Field of the Invention

This invention relates to preparing radioactive ion-exchange resins for disposal of their radioactively decaying atoms as waste. Decaying atoms attach to such resins by ion-exchange, for example, as nuclear power facilities clean the water which circulates inside the reactors. This specification teaches methods to reduce the volume of radioactive material which must be stored or buried after use of ion-exchange resins.

Exceeding results with present commercial practice in disposal of radioactive ion-exchange resins, this invention provides:

(i) removing water and its associated volume from the solid radioactive, ion-exchange resins, (ii) altering the chemical structure of the radioactive ion-exchange resins to remove ion-attractive groups, thereby avoiding further sorption of water, (iii) through the removal of the ion-attractive groups, also freeing the original radioactive ion-exchange resins from radioactive ions they had held, thereby forming simple polymer resin, (iv) depolymerizing simple polymer resin and vaporizing away nonradioactive vapors while retaining radioactive synthetic mineral, (v) operating in manner in which materials intended to be nonradioactive can be monitored for radioactivity prior to their release, and (vii) thus allowing safe release of material known to be nonradioactive, thereby reducing the volume of radioactive material that must be stored or buried.

This invention is urgently needed:

First, most commercial nuclear power plants in the United States have already lost all access to any burial for their radioactive wastes—such wastes must be stored. Also, most other commercial operations which generate radioactive waste are faced with an uncertain period of storage as their wastes accumulate. Without storage space most of the commercial operations indicated would have to close down. (Later note: The Barnwell burial site reopened Jul. 1, 1995.)

Long-term radioactive storage of radioactive wastes was being planned, for example, at the Perry nuclear power facility near Cleveland in October, 1992.

Both State and Federal new burial facilities were supposed to be prepared: Federal law once mandated that states would have to supply radioactive burial sites, but the requirement was overturned by the U.S. Supreme Court; litigation continues. The Federal burial site for commercial radioactive waste was supposed to be available in 1998, but estimates say it is 15 years behind schedule.

Second, open Federal sites for burial of radioactive wastes are rapidly filling while waste generation continues, and there are strong objections by U.S. citizens to any burial or transportation of radioactive materials.

Third, environmental logic requires that radioactive burial volumes be minimized. Lacking the teaching of this invention, current Federal practice is to bury considerably more waste than would be buried with improved practice as described in this invention. For those organizations which must store their radioactive wastes, excessive storage is illogical both environmentally and economically.

2. Description of the Related Art

As noted above, decaying atoms in water are often removed onto ion-exchange resin. In much industrial practice, and presumably also widely at Federal facilities, the radioactive ion-exchange resin is packaged wet in drums for storage or disposal. Because steel drums rust, concrete reinforcement was added for some physical protection against radioactive leakage.

Current practice often uses glass-reinforced plastic drums with no interior reinforcement against their damage. Other than to remove some of the water, the resin characteristics are not changed before storage or burial. Such resin, if exposed to weathering, can release radioactive atoms it holds.

Long-Term Burial: As noted above, long-term burial as used in most past practice is not now an option for most commercial generators of radioactive waste. Federal burial grounds are filling up, and Federal generators of nuclear waste are facing many future problems with burial, particularly excessive burial. Waste-volume reduction is needed.

Burial has always been considered a problem. In the inventor's experience from 1946 and still continuing, there has been concern that much buried radioactive material would have to be dug up and moved. Times and environmental concerns, as well as standards for acceptable burial, have changed, both as to form and volume of materials which are acceptable.

Ion-exchange resins have long been considered a special problem because they can pick up and hold large volumes of water of hydration, swelling in the process.

Open-Flow Incineration: The term open-flow incineration is used here for typical incineration such as is used in incinerating either garbage or wastes of paper and plastic. Here oxygen, usually in air mixed with other gases, flows over hot material and reduces the material substantially to ash. Typically, water vapor and carbon dioxide are the principal gases formed. Other gases, e.g., noxious oxides of nitrogen and of sulfur, may form. Bits of the ash dust typically will be carried along with the flowing gas.

Traps to remove the gaseous oxides, plus filters to remove the dust, can be installed along the flowing-gas path to the stack. Most of the time these traps work well, e.g., when such systems are used to burn mildly radioactive paper and rubber gloves, which generate ash.

Open-flow incineration systems neither (i) hold the gas for precise analysis for carried radioactivity before the gas is released to the atmosphere nor (ii) stop the incineration instantaneously if excessive radioactivity is detected in material escaping up the stack. One learns too late that something has gone wrong and uncontrolled decaying atoms are escaping.

A large incinerator at is planned Oak Ridge, Tenn., for commercial nuclear waste. Discussions by the inventor with incinerator personnel suggest that the facility will not be suitable for ion-exchange resin for reasons discussed below.

Incineration of Radioactive Ion-Exchange Resin: In addition to the incineration problems noted, radioactive ion-exchange resin lacks ash-forming materials to trap the radioactive dust released as incineration occurs. This dust, if not trapped, may be expected to be blown around by the gas stream.

Also, a significant fraction of the resin volume is as inorganic chemical groups which were put there to trap ions.

Incineration releases chemically nonradioactive but noxious gases which must be trapped for environmental reasons.

Trapping the noxious gases and the radioactive dust by conventional technology, even if the technology were to work perfectly, might actually increase the volume of radioactive waste to be stored or buried.

For these and other reasons, burial is widely preferred over open-flow incineration for disposal of radioactive ion-exchange resins—incineration often is not a good choice.

Because a dictionary definition of incineration involves "reducing something to ash," it is noted that incineration, as used in this disclosure, includes oxidation of carbonaceous residues in the vicinity of radioactive oxides or other salts to remove the carbon as carbon dioxide.

The treatment of this invention is not an open-flow system—rather, all gases are trapped and held available for radioactive monitoring before they are released.

Pyrolysis of Radioactive Ion-Exchange Resin: It is noted that pyrolysis is often combined inherently with incineration because of normal lack of local oxygen at heated combustion regions.

Such normal pyrolysis fails to utilize the concept of depolymerization, followed by pyrolysis, if that is required, as offered by the present invention. With more control of the chemical bond breakage, one can (i) depolymerize ion-exchange resin, (ii) meanwhile break off large organic fragments from the depolymerizing resin, (iii) thereby vaporizing mostly condensible vapors, and (iv) condense these vapors and monitor the condensate for radioactivity.

Over 95% reductions in the volumes of potentially radioactive gases generated may be achieved with the present invention, as compared with use of normal incineration practices.

Aqueous Oxidation: Processes are being developed that employ hydrogen peroxide to oxidize ion-exchange resin to carbon dioxide, water, and derivatives of sulfonyl and trimethyl amine groups.

As compared with the present invention, aqueous oxidation, like open flow incineration, generates very large volumes of potentially radioactive gas. With aqueous oxidation, the gas is generated in radioactive water which may become entrained in continuous gas flow. Such flow may lead to very finely divided, highly radioactive particles that, when dry, can be carried in even gentle winds.

Also, the system must be treated to handle sulfates and radioactive materials after the ion-exchange resin has been destroyed. The peroxide may also convert radioactive cations to anions, which may be harder to collect and dispose of than were the original anions.

With the present invention, in contrast, sulfates formed from the cation-exchange resin may become part of synthetic minerals, and anions present may become cations that coprecipitate readily inside the synthetic minerals. Such minerals have much better anticipated lives for protecting against release of decaying atoms than do steel, concrete, or plastic, as now used.

Other Methods of Decontamination from Decaying Atoms: Numerous other decontamination methods might remove and isolate decaying atoms from a source, e.g., coprecipitation alone, solvent extraction, vaporization, and leaching.

For solid radioactive material such as an ion-exchange resin, however, most of these techniques are substantially inoperable because the nonfluidity of the solid effectively blocks thorough removal of the decaying atoms in the interiors of solids.

Many customary techniques for handling solids such as metals or oxides use aqueous solutions to dissolve them. Such solutions can then be subjected to near-equilibrium separations processes. However, unless there is resin destruction, aqueous dissolutions are largely inoperable for solid radioactive ion-exchange resins.

Summary Regarding Related Art: The existing art for storage or burial of radioactive ion-exchange resins involves excessive volumes which are environmentally and economically unsatisfactory.

Likewise, the concepts of existing art for resin destruction appear to be environmentally and economically less satisfactory than are the concepts of the present invention.

Patents Noted:

Buchwalder, et al., U.S. Pat. No. 4,122,048, used a basic compound to block the active sites of certain contaminated ion-exchange resins so that these resins could be encapsulated in further resin for disposal. The procedure neither offers long-term environmental protection nor reduces the radioactive volume to be disposed of.

Laske, et al., U.S. Pat. No. 4,732,705, added various chemicals to reduce the swelling upon wetting of ion-exchange resins. This treatment may reduce the disposal volume of the resins, but it does not offer long-term environmental protection and may actually tend to release the radioactive ions the resin initially held.

Knotic, et al., U.S. Pat. No. 4,235,738, added high-boiling oil to ion-exchange resin prior to its heating to produce decomposition of the resin by carbonization. This treatment may assist in retaining the decaying atoms, especially by lowering the carbonization temperature, and avoiding some vaporization of decaying atoms. However, the carbonaceous material formed (i) fails to offer long-term environmental protection of the entrapped decaying atoms, and (ii) the carbon present during carbonization tends to increase the decomposition and vaporization of materials such as radioactive cesium oxide.

Kawamura, et al., U.S. Pat. Nos. 4,636,335 and 4,654,172, use low temperature pyrolysis to separate ion-exchange groups from ion-exchange resins prior to high temperature pyrolysis. Then the hot resin residues are compressed into a "molded article". They note, "In this way, decomposition gases generated during thermal decomposition are separated in two stages and gaseous nitrogen oxides ($NO_x$) and gaseous sulfur oxides ($SO_x$) which require careful exhaust gas disposal treatment are generated only in the first stage thermal decomposition . . . " ('335, column 2).

This Kawamura, et al., preliminary procedure reduces the volume of gas initially produced and yields a carbonaceous residue that provides largely physical, rather than chemical, trapping of the decaying atoms. However, the '172 claims 7–9 also note "presence of a vitrifying agent which absorbs volatile radioactive substances" that were "added before the pyrolysis at a low temperature" such as glass frit. A frit has substantially no contact with most of the decaying atoms, and it therefore cannot pick them up.

The '335 and '172 treatments (i) do not chemically anchor the decaying atoms in a condensed phase, i.e., as solid or liquid, prior to vaporizing resin components, (ii) do not afford dependable environmental protection against release of many radioactive elements if the hydrocarbons of the carbonaceous residue have become oxidized by air or otherwise, and (iii) do prevent precise reversal of the polymerization reactions which originally formed the ion-exchange resin.

SUMMARY OF THE INVENTION

This invention offers a new method for assisting in preparing ion-exchange resin holding decaying atoms, i.e., radioactive ion-exchange resin, for its disposal by reducing the volume of radioactive material which must be stored or buried after use of the ion-exchange resin to remove decaying atoms from radioactive water.

Before describing the concepts of the invention, it is useful to discuss the nature of ion-exchange resins in general and radioactive ion-exchange resins which are of particular interest here.

The Starting Nonradioactive Ion-Exchange Resin, Its Manufacture, and Some of Its Reactions: First, recognize that an ion-exchange resin is designed for either capture of cations or of anions, i.e, respectively, like $Na^+$ on cation-exchange resin or $Cl^-$ on anion exchange resin. In this invention the chemical treatments are primarily directed toward the cation-exchange resins, but the procedures to a large extent also lead to capture of the anions which were initially present, as is further discussed later.

A typical starting material for making ion-exchange resin will be what is often called polystyrene. It is in a class of polymers that are called synthetic resins. Before polymerization, the styrene ($C_6H_5—CH=CH_2$) usually will have been mixed with about 8% of divinyl benzene ($CH_2=CH—C_6H_4—CH=CH_2$), which causes cross-linking of the styrene/divinyl benzene chains during polymerization.

During polymerization, the double bonds shown above break to forms chains of mixed styrene and divinyl benzene, as indicated for styrene chains in Equation 1:

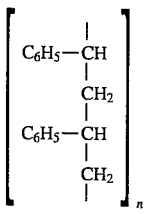

(1)

This polymer is not yet an ion-exchange resin—reactive chemical groups must be added with different groups being effective for attachment of cations or of anions. The polymer resin, often as beads or grains, must have been treated further. Either cation-exchange groups, e.g., sulfonic acid groups, which hold cations, or anion-exchange groups, e.g., quaternary ammonium groups, which hold anions, are added.

The sulfonic acid group attaches to carbon on a benzene-type ring of a polymerized styrene or divinyl benzene, while water is given up to concentrated sulfuric acid ($HOSO_2OH$) as represented below;

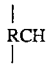

represents a styrene in a polymer chain:

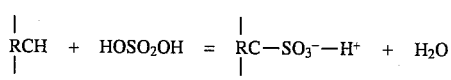

(2)

This is the hydrogen-ion form of the polystyrene cation-exchange resin. It readily gives up the hydrogen ion in exchange for other inorganic cations. The sodium ion exchange forms sodium sulfonate:

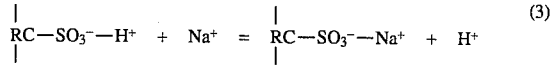

(3)

For $Ba^{++}$, two sulfonyl sites are converted to barium sulfonate forms:

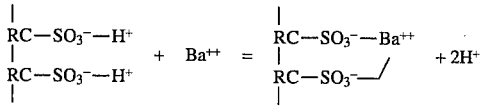

(4)

Usually the higher charged cations are held more strongly.

These bonds involving the sulfur are not yet referred to as "firmly bonded" because of the relative weakness of the $C—SO_3$ bond as compared with completely inorganic bonds, e.g., in $BaSO_4$. Bonds are discussed further below.

Radioactive Ion-Exchange from Nuclear Power Reactors: In the case of pressurized water nuclear reactors or boiling water nuclear reactors, most of the radioactive ions of decaying atoms are cations from corrosion of the metals in alloy containers for the water flow, but anionic species can also be present. Radioactive ions of cobalt, zinc, manganese, chromium, cesium, iron, technicium, antimony, iodine, hydrogen, carbon, and other elements may be present. Waste resin drums from nuclear power stations may give off 0.8 to 80 R/hr of nuclear radiation as registered on a hand monitor.

These radioactive ions attach to the ion-exchange resin to form radioactive ion-exchange resin, which is the material whose radioactive volume this patent seeks to reduce. The attachments by the radioactive ions are analogous to those by $Na^+$ and $Ba^{++}$, and the equations describing the cation-exchange resin behavior are like those for $Na^+$ and $Ba^{++}$, Eqs. 3 and 4. Both anions and cations of the metals appear to be amenable to treatment by the present invention.

Concepts of Use in the Invention: Thermodynamic data show that organic hydrocarbon compounds such as polystyrene resin are generally weakly bonded in a chemical sense, as compared with the firmly bonded structures of many inorganic substances.

For example, weakly bonded carbon-to-carbon attachments n polystyrene resin may break spontaneously in an inert atmosphere at 300° C. Such broken attachments may reform or form new linkages. Corollary resin decomposition will sometimes form gases, e.g., methane, and vapors, e.g., styrene and even larger molecules such as styrene dimer. The proportions of different compounds in vapor mixtures are influenced by numerous factors, e.g., heating rates and temperatures.

In contrast with the hydrocarbon compounds, many inorganic crystals are firmly bonded, e.g., barium sulfate, which can be heated at 800° C. in an inert atmosphere without significant breakage of its bonds. Likewise, anhydrous sodium sulfate is firmly bonded and can be heated to high temperatures. Furthermore, sodium sulfate dissolved as hydrated ions in water is also firmly bonded—the sodium sulfate would not have dissolved in water if it had not become even more firmly bonded in solution than it was as the anhydrous form. The solutions can be dried back down to anhydrous sodium sulfate.

Resin decompositions at temperatures in the range 150°–500° C. are affected by the presence of at least some other materials. For example, anchor materials that are selected primarily to assure that radioactive atoms will become permanently trapped for permanent disposal may also lead to formation of resin-decomposition catalysts. As in experimental Cases 1 and 2, discussed later, it appears that such catalysts can focus the breaking of carbon-to-carbon attachments to achieve resin decomposition by depolymerization, giving primarily styrene and divinyl benzene.

Simple pyrolysis gives a more complex spread of products.

Directed energy matching a particular bond strength may also be useful, e.g., using electromagnetic radiation that can add energy to, and break open, a particular type of bond. As examples, one might irradiate the radioactive ion-exchange resin with an energy which would readily break a type of bond at which one wishes to have reaction occur, e.g., to free substantially all radioactive material and sulfonic groups from an organic residue.

Catalysis suitable for efficient depolymerization of the organic polymer resin that has been freed from its radioactive material appears to occur with barium compounds. The presence of barium hydroxide, barium sulfate, or both, as the resin-decomposition catalyst experimentally led to large fractions of depolymerization with low fractions of relatively noncondensible gases and charry residues. This situation is valuable in operation of this invention.

Critical actions of anchor materials are to supply ions that bond to and anchor ion-exchange groups such as sulfonyl groups and to assure that most types of decaying atoms present will remain with the anchored ion-exchange groups. Eventually these decaying atoms and anchored sulfonyl groups will become firmly bonded radioactive material, e.g., radioactive synthetic barite.

One can first attach sulfonyl groups of a cation-exchange resin to anchoring ions from anchor material, e.g., $Ba^{++}$ from barium hydroxide, thereby forming barium sulfonates. With the sulfonate groups' bonds so anchored, it becomes possible to create conditions favoring chemical reactions that separate these groups from polymerized organic matter to which they had been attached. In these reactions the sulfonate groups in most cases become part of an inorganic sulfate; in some cases sulfite might also form. Meanwhile, the organic portion of the original ion-exchange resin becomes chemically free of, though mixed with, the radioactive material.

The amount of condensed-phase residues from resin decomposition, such as tarry materials and carbonaceous solids, appeared to increase with the release of gases or vapors other than styrene or divinyl benzene.

The interactions among carbon atoms in condensed-phase residues may produce firmly bonded structures in the sense that the residues do not undergo much thermal decomposition even at higher temperatures. Chemical interactions of such resins with inorganic materials are, in most cases, very weak.

These condensed-phase residues are not capable of firmly bonding to inorganic species such as cations or compounds of decaying atoms. However, these elements, which had earlier attached to the sulfonic acid cation-exchange resin, might become physically trapped for some time, e.g., until the tars oxidize away during burial or storage and allow the decaying atoms to escape.

Attachments of polystyrene to sulfonyl or quaternary ammonia groups are particularly weakly bonded. Some release of these groups can be achieved by heating ion-exchange resins at less than 300° C. for example.

The novel group of steps which comprise this invention are based in part on understanding of the chemical concepts above. Unobviousness is evident from existence of the problem of excess burial volumes in disposal of radioactive ion-exchange resins that has existed for over forty years.

The Broad Concept: The letters in parentheses in the following discussion correspond with those in Claim 1.

The central concept of this invention is to allow reaction among (a) radioactive ion-exchange resin that includes decaying atoms and cation-exchange resin, (b) anchor material that can supply anchoring ions that can react at least in part with the decaying atoms and the cation-exchange resin, and (c) water in some form. These materials (d) are brought together where they can react. Usually the initial reactions are at room temperature.

Included among various possible activities of the water are forming hydrated ions, acting as a medium in which reactions may take place, and resupplying reactant $H_2O$ which was generated and removed during manufacture of the cation-exchange resin. This $H_2O$ resupply may be useful prior to decomposition of the ion-exchange resin, as discussed below.

One reaction is (e) the attachment of anchoring ions to the cation-exchange resin. These anchoring ions are supplied by the anchor material, typically through the water, to the cation-exchange group on the resin. This attachment replaces the hydrogen ions on the resin with anchoring ions, but the cation-exchange group remains attached to the resin, e.g., typically a sulfonate group on polystyrene, as discussed earlier. Anchored cations on first-treated resin are formed.

Also, (f) the anchoring ions provide an aqueous ionic environment in which radioactive ions are held by charge interactions. Whether anions or cations, and whether the species are in aqueous solution or are on cation or anion resin, these ions cannot readily escape even if the resin is being destroyed or, later, being removed. Anchored decaying atoms are created.

Next, (g) bonds from a cation-exchange site to an organic portion of the resin are exposed to reaction by supplying energy and a third portion of anchoring ions at points where organic/inorganic bonds join organic portions of the first-treated resin to the anchored cation-exchange groups. Because the anchoring ions have attached with strong bonds to, for example, form a sulfonate group, the attachment of the carbon of the resin, i.e., of the organic polymer, to the sulfonate group has become more vulnerable to attack, and such an attack may become highly selective.

Once an organic/inorganic bond has been prepared for reaction, it becomes possible for (h) the anchored cation-exchange groups to attach additional anchoring ions and convert, for example, a sulfonate group to inorganic sulfates or sulfites. If cation-exchange groups other than sulfonate groups are present, they also in most cases will be converted to similar inorganic compounds.

Such inorganic materials are firmly bonded, both as the major components and as the radioactive ions the major components hold. These inorganic materials are at least in part chemically freed from organic material.

If water reacts at an organic/inorganic bond at the time other reactions are taking place, this will allow reversal of the sulfonation reaction that was carried out during manufacture of the cation-exchange resin. This sulfonation reaction involved water removal to concentrated sulfuric acid and formation of the sulfonyl groups. With regeneration of the sulfate group by the water reaction, it is possible to form principally sulfates, e.g., $BaSO_4$.

These sulfates, and sulfites, if present, are readily separable from the organic material even though they are physically mixed with organic material.

Once the inorganic material has formed, (i) the organic polymer residue is also chemically freed from the anchored cation-exchange groups. Depending on what has happened at the organic portion of the organic/inorganic bond, a number of reactions may take place. With the water addition mentioned, polystyrene may have reformed. Without the water addition, there is a hydrogen shortage in the organic region, and other species presumably will have formed.

With organic and inorganic materials physically mixed, (j) any of a number of physical separations would potentially be useful:

The preferred embodiment assumes approximate conformance to a two-step separation in which the "polystyrene" resin first depolymerizes to styrene and divinyl benzene, then these materials vaporize away to condense as materials which are either already nonradioactive or can be made so.

Even without vaporization, if sufficiently heated the resin can liquefy by a combination of factors such as direct melting and dissolution of the polymer in styrene and divinyl benzene or their small aggregates such as dimers, etc. Also, other solvents could be added to assist the polymer dissolution.

Once the organic polymer residue became largely liquefied, it could be filtered or decanted away from an inorganic residue such as $BaSO_4$ residue rather than requiring vaporization as in the preferred embodiment.

Overlapping of the Steps: It is not assumed that these steps will be individually observable. For example, on a microscopic scale the method may be conceived of as successive steps of separating substantially nonradioactive material from a radioactive ion-exchange resin while retaining the decaying atoms in smaller and smaller volume. However, the steps may be largely conceptual.

For example, an intermediate step of melting may, or may not, be identifiable when depolymerization, vaporization, and sublimation of organic vapors take place at solid/liquid mixtures of hot, partially depolymerized resin. However, the existence of some sort of melting is important in opening the ion-exchange resin to reaction.

It is important to recognize that, on the bulk scale in commercial operations, these steps routinely will take place at different times in different portions of the resin.

All the steps listed are believed to be consistent with the inventor's experiments and other somewhat related experiments of which he is aware.

Variations within the Broad Concept: Formation of firmly bonded radioactive material including other elements from the group consisting of Groups IA, IIA, and IIIB of the periodic table are noted as sources other than barium hydroxide and NaOH-KOH mixtures. Other anchor materials might be used to provide hydroxide.

Air is normally excluded in steps g to j in the section on The Broad Concept above to prevent cation oxidation to anions. Inert gases may be used to displace the air.

Energy must be supplied as described in step g in the section on The Broad Concept above. Both heat and electromagnetic energy may be useful, alone or together. Application of this energy may allow water to react chemically at the opened bonds. Such reaction may effectively reverse the sulfonation reaction used during the manufacturing of the starting sulfonated resin.

Firmly bonded synthetic barite, $BaSO_4$, forms as the radioactive ion-exchange resin is separated chemically into organic and inorganic fractions in the preferred embodiment. The barite formation also causes precipitation of radioactive ions and encases these decaying atoms that had been held on the radioactive ion-exchange resin. The decaying atoms, as they are released from organic attachment, may simply attach to the barite and be engulfed, but usually there is also coprecipitation in which $Ba^{++}$ and $SO_4^{=}$ sites are occupied by radioactive ions. For examples, one may choose to think of $FeSO_4$ from $Fe^{++}$ and $BaCrO_4$ from $CrO_4^{=}$ in solid solution in the $BaSO_4$ host. Thus both anions and cations of the radioactive elements of most interest at boiling water reactors can be accomodated in the barite.

Furthermore, the reduction of many anions by hot organic matter prior to bulk formation of the barite will lead to most radioactive elements being present as cations. After the formation of bulk barite, air cannot reach the radioactive elements because they are almost totally within the barite crystals' ionic lattices.

Both the synthetic barite and the radioactive ions that it holds are considered to be firmly bonded, i.e., the bonds are strong enough so they cannot readily be broken.

Decaying atoms in NaOH-KOH mixtures or the corresponding sulfates, along with similar compositions including elements from the group consisting of Groups IA, IIA, and IIIB of the periodic table, are also firmly bonded.

Depolymerization of the organic polymer residue can be used at least in part to form depolymerized residue prior to physical separation of organic material from the firmly bonded radioactive material. Relative to solid polymerized resin, the depolymerized residue may be largely or entirely liquid and may have largely components that are readily volatile.

The bulk physical separation may be achieved at least in part by vaporization with corollary transport to condensation elsewhere of the depolymerized residue. The effect is to create vaporization residue, if vaporization is not complete, plus vapor transported organic material. Vaporization and vapor transport may be assisted by the flow of an inert carrier gas that carries components of depolymerized resin as vapor at less than atmospheric pressure; such flow allows major vapor movement at less than the atmospheric boiling temperature.

Portions of a vaporization residue may be further removed by pyrolysis or oxidation, either or both.

As noted earlier, radioactive anions that have been heated above room temperature may be reduced to cations by reaction with organic materials. Such reaction can occur at lower temperatures but is normally strong at temperatures where chemical separation of firmly bonded radioactive material from organic polymer residue takes place.

Bulk physical separation of firmly bonded material and liquefied organic polymer residue may also be achieved by filtration or decantation that pass the liquid and retain the firmly bonded material. Although highly efficient separations are normally most useful, even retention of only 75% of the radioactive material present may be useful for some types of decaying atoms.

The present invention was designed to allow retention of all separated materials until they had been monitored for radioactivity. This approach avoids a common problem met by incinerators and other units that release large volumes of radioactive gases flowing continuously. Such units have periodic releases of radioactive material to the atmosphere when the filtration system breaks down. In contrast, the present invention provides that (i) any problems in the retained organic materials can be detected and corrected before there is release, (ii) gas volumes are very small because large organic molecules are vaporized, and (iii) very few noncondensible gases are formed. If unwanted radioactivity is detected, the material can be cleaned up before it is released.

As with organic/aqueous solvent extraction, an aqueous wash, e.g., with dilute acid, can remove most possible radioactive contaminants from organic materials which have been retained for radioactive monitoring. If decaying atoms are detected, most will have been physically carried in the moving vapor, and the aqueous environment will be more favorable to them than will the organic.

Usual anion-exchange resin would release trimethylamine during the course of this invention. This material could collect in the vapor transported organic material. Acid washing would remove the trimethylamine as a dissolved salt.

Treatment of Radioactive Ion-Exchange Resins in the Parent Application: In the parent application for this continuation-in-part, mixtures of NaOH and KOH were the preferred chemicals for making possible this invention's separation of radioactive ion-exchange resins into radioactive and nonradioactive portions—physical separations are made of radioactive material holding decaying atoms and other material which could be disposed of on a nonradioactive basis.

However, $Ba(OH)_2 \cdot 8H_2O$ now provides the preferred embodiment for the separation of this invention and has been emphasized.

The following discussion of the NaOH-KOH mixtures has been retained with small modifications to save the historical record of the parent application.

Reduction of the Radioactive Volume As Described in the Parent Application: To achieve the volume reduction for radioactivity from radioactive ion-exchange resins, one typically goes through several processes. The processes listed separately below are often going on simultaneously. They lead to effecting various steps of the claims made. Other processes may also be used and not all processes are necessary:

(i) Partial moisture removal and corollary separation of some nonradioactive water from even the solid radioactive ion-exchange resin normally can take place without difficulty. Squeezing, evacuation, and vaporizing are used commercially.

Complete water removal requires resin alteration. Partial water removal must be considered temporary unless further action is taken to destroy the ability of the radioactive ion-exchange resin to again sorb water.

(ii) Mixed hydroxides of sodium and potassium are often good material to add to firmly bind and hold decaying atoms which have attached to the ion-exchange resin. At 1/1 mol ratio and no excess water, these hydroxides fuse at 170° C. If even small amounts water are present, these solutions form liquids at lower temperatures yet retain the ability to firmly bind the decaying atoms. The firmly bound decaying atoms will not escape from the hydroxide environment even if the organic material is chemically separated and removed from the decaying atoms.

On drying of sodium and potassium hydroxide which have picked up sulfate (see next paragraph) and hold decaying atoms, the decaying atoms will be held as oxides or other salts mixed in the otherwise nonradioactive bulk. They will not be dusty. If desired, the hydroxides can be neutralized for long-term storage.

(iii) These same hydroxides, particularly if fused, can remove a cation-exchange sulfonyl reactive chemical group or similar group from a benzene ring and form a phenolic group which is neutralized by hydroxide. This replacement is important because it will allow later depolymerization and vaporization of decontaminated fragments of the substrate material of the radioactive ion-exchange resin.

The hydroxide can also release, for example, trimethyl amine from a quaternary amine anion-attracting reactive chemical group and leave a —$CH_2OH$ group on the benzene ring. The trimethyl amine or its decomposition products can then escape as gas and be trapped in water or acid.

Thus, the hydroxide addition can prepare the system for depolymerization, vaporization, and controlled pyrolysis as will be discussed.

(iv) Heating the radioactive ion-exchange resin will partially depolymerize it. Partial liquefaction will occur both by the depolymerization and by melting of still polymerized segments of linear polymer. Normally the inventor has found it simple and effective to heat gently under air-free conditions which will allow the separational chemical reactions without oxidation.

Depolymerization leads apparently to some, but not complete, unbonding of the polystyrene and other chains.

Regarding the depolymerization, recognize that the polymer initially produced was changed to form the ion-exchange resin. Therefore, the depolymerized materials will be modified relative to the original materials which were polymerized.

(v) Along with liquefaction the separational chemical reactions gradually shift to form different fragments as the polymer decomposition moves into the more heavily cross linked regions. As the resin decomposition proceeds, the temperature rises, the color of the decomposition products changes, and the residual solid polymer eventually becomes a charry residue.

(vi) Also, as the ion-exchange resin breaks into the fragments, vaporization of the depolymerized material takes place. This vaporization is important and useful because it separates substantially nonradioactive material from the radioactive residue.

Vaporization aids are useful in retaining large, nonradioactive, organic fragments. Here water vaporization can provide elements of steam distillation. And lowered pressure can let the fragments boil at lower temperatures.

(vii) Pyrolytic degradation breaks bonds in the cross-linked portion of the radioactive resin residue. Most of the degradation products from these separational chemical reactions are volatile at the temperatures used for depolymerization or the often higher temperatures used for pyrolysis. Vaporization is one of the better ways to separate volatile nonradioactive fragments formed here because the radioactive salts are effectively nonvolatile. Often it is useful to operate at less than atmospheric pressure. Other techniques again may be useful in assisting the vaporization, e.g., by steam distillation.

For a cross-linked ion-exchange resin like those made from styrene-8% divinyl benzene, slowly raising the temperature can break more and more bonds and release more and more volatile fragments until finally a charry residue is left.

Recognize that the charry residue will also hold remains of reactive chemical groups such as sulfonic acid and perhaps quaternary amines on oxides or other salts. From the radioactive ion exchange resins, decaying atoms will be imbedded in the charry residue. These decaying atoms are not firmly bonded, however.

Objects of the Invention with Explanations as Taken from the Parent Application

Various steps in the method may in some cases take place substantially simultaneously. While the steps are described with use of well known terms for different types of chemical reactions, to optimize the effects of these reactions they should be carried in specialized ways as taught in this section, in the description of the preferred embodiments, and elsewhere in the specification.

(1) One object of this invention is a method of preparing ion-exchange resin holding radioactive material including decaying atoms for its disposal comprising the steps below.

(1a) At least part of the radioactive material is chemically attached to a bonding material such that decaying atoms become at least in part firmly bonded, whereby parent application first-treated resin residue is created.

"Bonding material", as used with this section of the parent application, is replaced elsewhere in this continuation-in-part by "anchor material" and "anchoring ions", which are derived from anchor material.

"Firmly bonded" requires that the decaying atoms will remain substantially in a nonvolatile form in a condensed phase (liquid or solid) with the bonding material even when organic materials to which it has been attached (through an inorganic group) are breaking free of the resin, of the radioactivity, or of both. Firmly bonded is restricted to inorganic bonds.

The bonds of ion-exchange resin to the decaying atoms are not broken all at once, so the reactions to attach the decaying atoms to the bonding material should be carried out gently. Too vigorous reaction may prematurely break bonds, spatter liquid solutions and carry decaying atoms in several ways, e.g., in droplets, as solids, in decaying atoms still attached to organic fragments, etc. Carried decaying atoms may contaminate the system where it should be free of radioactivity.

With the precautions taught in this specification, and with experimental preparation to learn the behavior of the particular ion-exchange resin system involved, the inventor's experiments have shown that firmly bonded decaying atoms can be formed without substantial transport of decaying atoms.

Many metallic oxides form suitable firmly bonded decaying atoms. The inventor has found that mixed sodium and potassium hydroxide have special usefulness in several ways: Molten hydroxides or hydroxide solutions can be used as mobile and readily reactive liquids. The liquids can be contacted with radioactive organic phases to attach both to anionic and cationic decaying atoms. They can also attach to inorganic groups which are chemically attached to resins to create ion-exchange resins. Glass powder may also be a useful oxide which can be made fluid. Other oxides, usually as powders, and other reactive chemicals, can be used similarly to attach to decaying atoms or inorganic resin groups.

Other molten salts and aqueous solutions are examples of other sources to firmly bond radioactivity.

(1b) A chemical separation of at least part of the firmly bonded radioactivity from parent-application first-treated resin residue is effected, whereby parent-application second-treated resin residue at least partially freed of chemically attached decaying atoms is created.

Heating to effect the chemical separation is a preferred method. Other sources of energy are also potentially useful, e.g., radiation, ultrasonics, or oxidation-reduction reactions.

With ion-exchange resin one must be careful in this chemical separation step. One should be confident the firmly bonded decaying atoms either have formed or will be formed as the parent-application first-treated resin and parent-application second-treated resins are also formed. Specifics of this treatment for various possible ion-exchange resins and forms of decaying atoms should be studied experimentally for best performance of a separation unit.

For this chemical separation step, poorly miscible radioactive and nonradioactive components may remain physically mixed or even dissolved, but the decaying atoms should not remain chemically on the resin residue. In particular, in the event of separation of radioactive and nonradioactive phases, the decaying atoms will substantially follow bonding material rather than the resin residue.

The chemical separation often may also usefully remove ion-attracting chemical species from the ion-exchange resin, thereby destroying the ability of the resin to hold radioactive ions. Again the precautions just mentioned regarding gentle treatment and experimental studies of the particular system will hold.

Removal from the ion-exchange resin of sulfate precursors and of nitrogen species along with decaying atoms by the bonding material is particularly notable from an environmental standpoint. These three pollutants create key problems with incineration of radioactive ion-exchange resins and have worked to make incineration of ion-exchange resins largely impractical.

In addition, the major driving force for water sorption and retention by the ion-exchange resin is the establishment of an osmosis-like equilibrium involving sorbed ions on the resin. Removal of the ion-exchange component of the resin greatly reduces the resin's capacity to hold water.

Here different radioactive ion-exchange resins with different attached and sorbed ions will behave differently toward moisture, and the appropriate chemistry should be evaluated theoretically and experimentally.

(1c) Depolymerizing, at least in part, the parent-application second-treated resin residue, whereby at least partially depolymerized parent-application resin residue is created.

Depolymerization is dependent on conditions in the system. The inventor has found that partial evacuation while heating the ion-exchange resin or resin residues is useful if used in moderation. If moisture is present, evacuation of the heated mixture will largely remove the moisture. Also, it will assist vaporization of large nonradioactive organic fragments from the resin residues.

Too much evacuation can lead to excessive volumes of gas flow plus boiling and bumping. Corollary physical transport of decaying atoms in liquid droplets may occur. Again the teaching of this invention should be heeded, and experimental studies should be carried out prior to operating commercially.

Polymerized resin is solid, though porous, and has chemical similarities to synthetic rubber. As such it will resist treatments to separate its decaying atoms from the bulk material, and its resistive character must be destroyed. The inventor prefers depolymerization to the extent possible to turn the hot solid largely into a liquid.

Polymerized resin is also capable of holding large amounts of water if the conditions are suitable. Problems with this water retention are discussed elsewhere.

As the process of this invention has developed following the inventor's experiments, depolymerization has allowed removal of large fractions of the original ion-exchange resin. The fractions removed normally include separate phases of water and of nonradioactive organic materials, most of which can be largely separated away from nonvolatile radioactive residues.

The condensed vapors from depolymerization are potentially disposable as useful chemical feedstocks or as nonradioactive wastes which can be incinerated by usual techniques.

Depolymerization of the second-treated resin residue also may create largely immiscible liquid solutions suitable for aqueous-organic solvent extraction if that technique is to be used for radioactive separations.

Heating rates of the resins and residues influence the amount of char formed in the resin residues, and the specific resin behavior should be studied theoretically and experimentally.

The inventor's experiments with NaOH-KOH bonding material also show that the cross-linkage portion of the resin (often about 8% cross-linked) will not necessarily depolymerize, but this portion can be pyrolyzed to give further decomposition of the original resin.

(1d) Bulk physical separation of at least part of the second-treated resin residue from the firmly bonded decaying atoms is effected, whereby substantially nonradioactive parent-application resin residue is created.

In the inventor's experience in working on this invention, it is preferable to use vaporization and condensation to effect the physical separation. In commercial practice, once an engineer understands the techniques here taught, and assuming use of a suitable separation container built to conform to these teachings, the separation is technically possible and will not be unduly difficult to effect. With the preferred embodiment as tested at bench scale by the inventor, the vaporization and condensation have given excellent separation of nonradioactive moisture and organic fragments from a radioactive residue.

Other techniques of separation could be used, e.g., aqueous-organic solvent extraction. Again here the conditions under which the chemical steps have been taken may infuence the nature of the materials being solvent extracted.

(1e) In carrying out the steps above, at least one separation container Is used which will allow retention of at least part of one product resulting from the steps until it can be determined that unwanted release of decaying atoms will not occur as supposedly substantially nonradioactive resin residue is removed for nonradioactive disposal with corollary reduction in the space required for the radioactive disposal.

Separation containers used for the preceding steps should be capable of substantially being sealed, evacuated, pressurized, heated, loaded, and unloaded. They should be sufficiently resistive to reaction with the container contents. They should allow separation of various chemical fractions such as chemical reactants from various products. They should allow measuring, sampling, analyzing, and chemically treating of the container contents in locations where they are collected.

(2) Another object of this invention is effecting one or more of the steps of the invention at least in part by heating.

Most often in the inventor's experiments resistance heaters, natural gas combustion, or electronic ovens have been used as the heat sources.

(3) Another object of this invention is effecting at least in part one or more steps of the invention in a separation container while the separation container is hermetically sealed.

The control and retention of decaying atoms until nonradioactive portions of separated materials can be monitored is a critical aspect of this invention. Hermetic sealing is one preferred method of such control.

(4) Another object of this invention is effecting at least in part one or more steps of the invention in a separation container while the separation container is operating at other than atmospheric internal pressure.

As noted above lowering the pressure often beneficially increases the fraction of large, nonradioactive gaseous molecules evolved during depolymerization or pyrolysis of the resin residue.

Raising the pressure in the container may beneficially assist the condensation of gases which have been liberated and are to be condensed.

(5) Another object of this invention is effecting at least in part one or more steps of the invention at least in part in a separation container while the separation container is operating with an atmosphere in which the thermodynamic activity of oxygen is controlled.

Control of oxygen activity is important, for example, in the decomposition of the resin. Under reducing conditions the pyrolysis leads to vaporization of relatively large, substantially nonradioactive organic species which can subsequently be condensed in cooler portions of the vessel. With oxidizing conditions following the pyrolysis, carbon dioxide and moisture can form. The moisture is usually readily condensible; the carbon dioxide may require both pressure and cooling to get it to condense for monitoring before releasing it in nonradioactive form.

Oxygen activity also is important in other ways.

(6) Another object of this invention is pyrolyzing resin residue to break volatile organic fragments from the resin residue under reducing oxygen activity.

The inventor's experiments show that pyrolysis of resin residues can be made to form largely condensible, nonradioactive vapors. Residual carbonaceous residue which forms can be crushed readily and does not hold significant amounts of water. The carbonaceous residue which may remain along with the firmly bonded decaying atoms after pyrolysis may trap some decaying atoms which may be disposed of as radioactive material, if no other treatment is used. Heating rates, pressures, and temperatures alter the character of the carbonaceous residue.

(7) Another object of this invention is forming at least some carbon dioxide from substantially nonvolatile carbonaceous residue under oxidizing conditions.

Formation of carbon dioxide may be disadvantageous in the early steps of the claimed invention, as discussed regarding the fifth object of this invention. Specifically; carbon dioxide formation may (i) excessively raise internal pressures in a separation container, (ii) hinder vapor transport of larger organic molecules to condensation sites after these larger molecules have been separated from the firmly bonded decaying atoms, and (iii) create gas volumes which are difficult to hold until they have been monitored to assure they are substantially free of decaying atoms. The inventor's experiments, however, show that formation of carbon dioxide in later stages of the invention can be useful in removing residual carbonaceous chars from radioactive residues of resin decompositions.

(8) Another object of this invention is using a catalyst in the decomposition of a resin residue.

Catalysts such as oxides of copper and manganese can assist in the formation of carbon dioxide, and a catalyst used in the polymerization of the resin base of an ion-exchange resin can also assist in its depolymerization.

(9) Another object of this invention is forming and moving of at least one component of a resin residue as a vapor which condenses in substantially nonradioactive form.

Gas and vapor transport of nonradioactive organic species represents the preferred embodiment of this invention. However, this preference does not exclude other techniques such as solvent extraction of a nonradioactive organic phase away from an aqueous phase or a precipitated solid.

(10) Another object of this invention is using at least one type of material comprising metallic oxide to at least in part form said firmly bonded decaying atoms.

(11) Another object of this invention is using a metallic hydroxide at least in part as the material which comprises metallic oxide.

(12) Another object of this invention is trapping potential air pollutants on substantially stable and nonvolatile salt.

(13) Another object of this invention is specifically the binding into salt of chemical groups which would complicate later disposal of substantially nonradioactive resin residue by incineration.

Complications would arise, for example, through formation of noxious gases arising from incineration of the inorganic groups which are attached to the resins to convert them to ion-exchange resins. This matter is discussed elsewhere—as noted, incineration of the noxious gases might require scrubbers which added to the radioactive volume actually required for waste disposal.

(14) Another object of this invention is chemically altering ion-exchange resin holding radioactive material to render it substantially incapable of holding moisture.

As discussed elsewhere, removal of the inorganic species added into the original ion-exchange resin destroys the ion-exchange characteristics and their associated ability to hold water. Depolymerization also avoids some water retention by the resin.

As noted earlier commercial practice demands that the ion-exchange resin cannot be disposed of dry because of the potential to expand and break its drums.

(15) Another object of this invention is the use of solvent extraction to separate nonradioactive material from radioactive material by chemical alteration of the original ion-exchange material holding decaying atoms.

By altering the solubility characteristics of the ion-exchange resin in organic solvents and water, the chemical changes imposed on the ion-exchange resin make feasible otherwise impractical separations processes such as aqueous-organic solvent extraction. For example, depolymerizing the ion-exchange resin may either directly liquefy the material produced or may transform the resin enough so it will dissolve more readily in a solvent. Here the liquid fluidity allows intimate contacting between phases in a way which is not feasible with solids.

(16) A further object of this invention is to monitor a separated phase while it is still in containment in order to assure it is substantially nonradioactive.

In this preferred embodiment, most material separated from radioactivity by vaporization is trapped in liquid form. This material can be monitored much more accurately than, for example, flowing gas.

(17) A further object of this invention is to use a technique to assist transport of organic vapor to a condensation region of a separation container.

Water present in the hydroxide is used in steam distillation to assist the organic vapor transport. Water may be usefully added to the hydroxide to resupply a steam source. Likewise, other gases can be used as carrier gases for the organic vapor transport. And lowering the system pressure in a hermetically sealed condensation container can increase the boiling and improve the vapor transport over what would be met at higher pressure.

Still other objects, advantages, and novel features of this invention will be apparent to those of ordinary skill in the art upon examination of the follow in a detailed description of preferred embodiments of the invention and the accompanying drawings.

DESCRIPTION OF THE PREFERRED EMBODIMENT

Preliminary Comments: These figures show the preferred treatments of radioactive ion-exchange resins. The embodiments described are consistent with treatments now used for ion-exchange resins contaminated by water carried by alloyed metal tubing through certain nuclear reactors at power stations.

For teaching the method of this invention, the figures show chemically or physically important stages of the treatments: For each figure, on a local scale the stage order indicated is substantially followed, although the stage times may be almost simultaneous, as is discussed later. On the bulk scale the stages are reached at different times as the solid resin depolymerizes over a period of time because only the resin surface is exposed to reaction.

Figure 1:
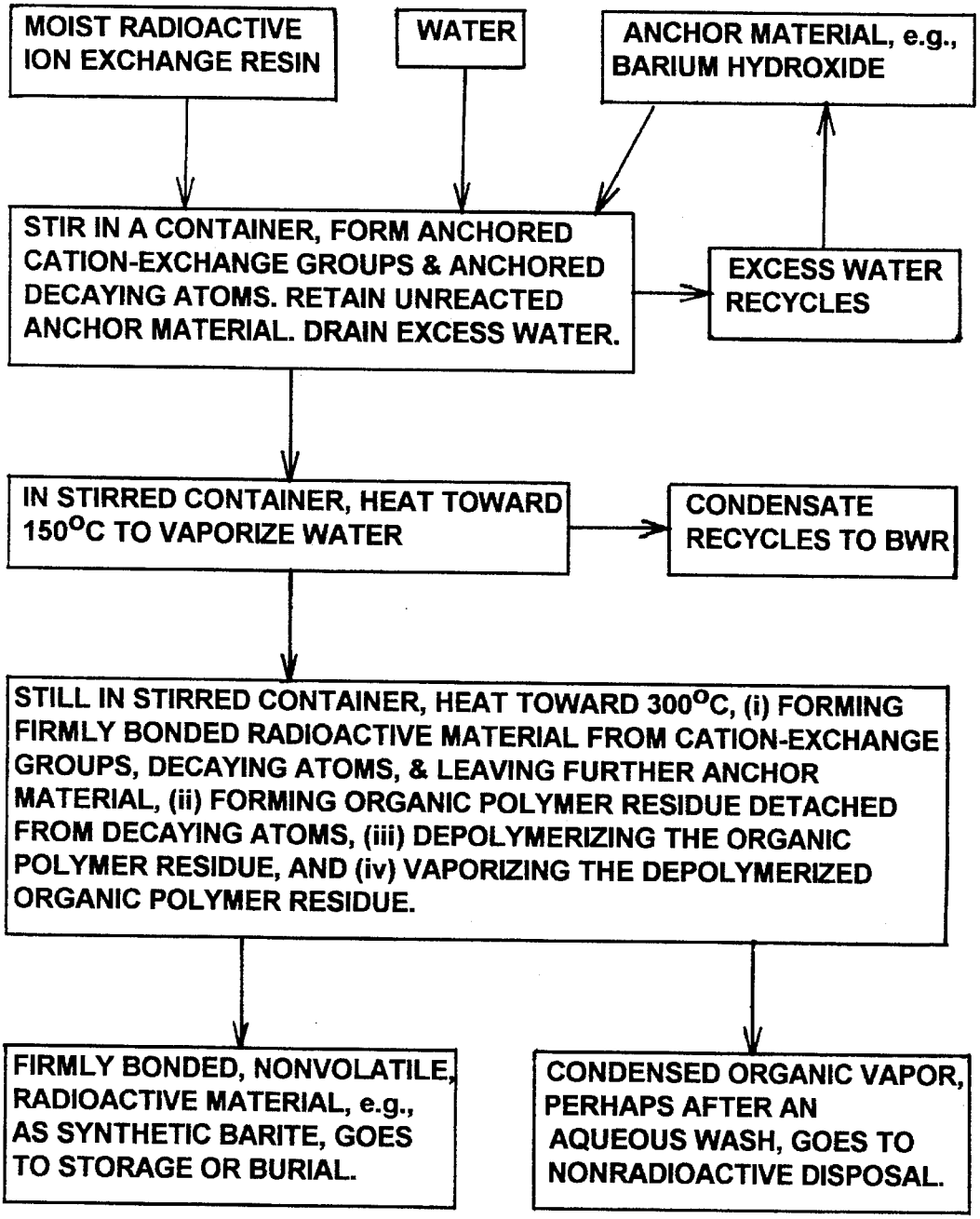
FIG. 1 is a preferred flow diagram with the $Ba(OH)_2$ system for preparation of radioactive ion-exchange resin for storage or disposal by burial.

FIG. 1: This figure shows the preferred embodiment for treatment to reduce the burial volume for radioactive ion-exchange resin when barium hydroxide is the anchor material supplied.

FIG. 1 Stage 1: A sealable container with stirrer is supplied an aqueous slurry of barium hydroxide anchor material and radioactive ion-exchange resin, e.g., from operations of a BWR nuclear-electric power station. Barium anchoring ions, $Ba^{++}$, load hydrogen ion sites of the ion-exchange resin, thereby anchoring the cation-exchange groups, here sulfonate groups, and decaying atoms, which may be on the resin or in aqueous solution. First-treated resin is formed. Excess anchoring ions also remain, and water is drained off for recycle to more aqueous slurry.

FIG. 1, Stage 2: By heating the stirred container to a suitable temperature, e g., to 150° C., water vapor is driven off and is collected for recycle to the BWR turbine generator.

FIG. 1, Stage 3: By further heating toward 300° C., a series of reactions take place. (i) Heat and further anchoring ions, perhaps with the assistance of water, attack the bonds between the anchored cation-exchange groups, here sulfonate groups, and the organic portion of the first-treated resin; the attack converts sulfonyl groups to firmly bonded radioactive material such as radioactive $BaSO_4$, i.e., synthetic barite mineral, that is at least in part chemically freed from organic material. (ii) The attack also releases organic polymer residue that is at least in part freed from anchored sulfonate groups and their attached decaying atoms. (iii) The heated organic polymer residue is also allowed to depolymerize, at least in part, and barium compounds may catalyze the depolymerization. (iv) Vaporization of the depolymerized resin allows the organic material to be removed from the firmly bonded radioactive material and be collected elsewhere.

FIG. 1, Stage 4: The condensed organic vapor may need final purification, e.g., washing with dilute acid to remove contaminants such as traces of radioactive material or hazardous material or trimethyl amine from anion resin that may have been present.

FIG. 1, Stage 5: The firmly bonded radioactive material goes to storage or burial, and the condensed organic material goes to nonradioactive disposal.

Figure 2:
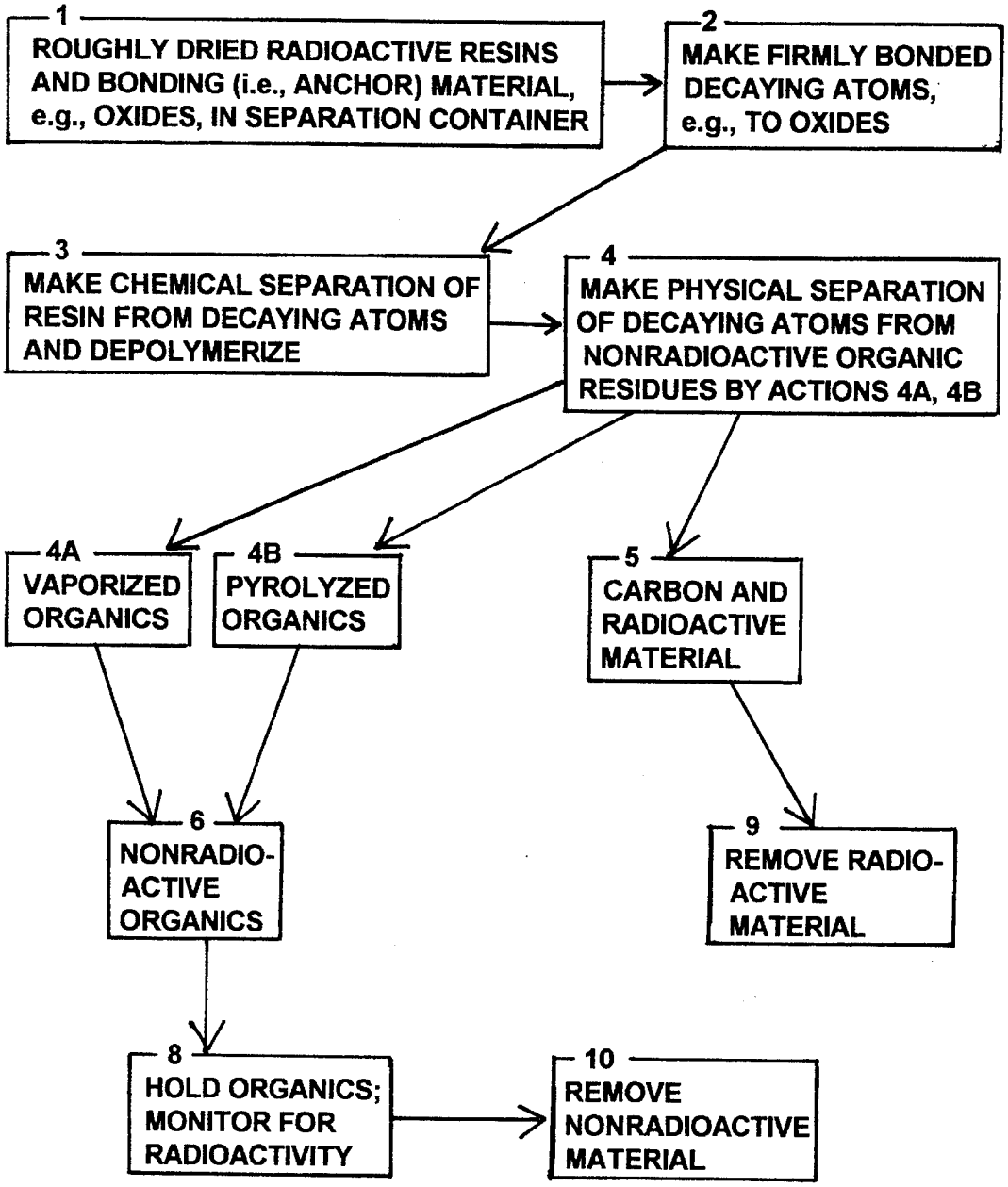
FIG. 2 is a preferred flow diagram with the NaOH-KOH system for preparation of radioactive ion-exchange resin for storage or disposal by burial.

FIG. 2, Stage 1: The system is supplied radioactive ion-exchange resin that has been roughly dried consistent with power station policy, e.g., by squeezing it and pumping vapor from it. This resin is placed in a separation containalong with bonding material (also called anchor material) which, in this preferred embodiment, is a mixture of sodium hydroxide and potassium hydroxide. Aqueous hydroxides form immediately. Other materials comprising oxides could also be used in powder or liquid form, or in other form which could make firmly bonded radioactivity of the next stage.

FIG. 2: This figure shows the earlier preferred embodiment to reduce the burial volume for radioactive ion-exchange resin when sodium hydroxide-potassium hydroxide is the bonding (i.e., anchor) material supplied.

FIG. 2, Stage 2: The hydroxide solution brings strong ionic environments around both the exposed radioactive ions and the ion-exchange structures attached to the resins. Many surface radioactive ions will move into the hydroxide-solution region—there the radioactive ions are surrounded by ionic fields which bond them more firmly than nonionic organic regions of the resin can do it.

Also, the inorganic ion-exchange groups bonded to the organic resin become subject to strong bonding from the ionic aqueous phase. If thermal agitation breaks organic bonds, the originally ion-exchange groups will remain with an ionic aqueous phase or other largely ionic phase.

Ion exchange will lead to some removal of interior decaying atoms out to hydroxide solution. However, completing Stage 2 will require conversion of the resin to a different form which gives the hydroxide access to the interior of the solid resin. Heating and various decomposition stages as follow are used to give that access.

FIG. 2, Stage 3: Heating of the hydroxide-resin mixture is carried out in a portion of the separation container. The heating, assisted by catalytic and chemical action of the hydroxide, causes (i) depolymerization of much of the resin to form organic liquid solution which is largely immiscible with water, (ii) separation of much of the decaying atoms and much of the ion-exchange portion the resin into aqueous ionic solution, and (iii) formation of some resin residue mixed with some trapped decaying atoms, which mixture is immiscible with either the aqueous or the organic phase.

FIG. 2, Stage 4: In this embodiment the physical separation of the decaying atoms from the organic material is primarily by vapor transport. The vaporization and subsequent condensation in another region of the separation container moves major portions of the nonradioactive material where it can be collected and be moved on toward disposal.

The vapor transport is assisted by water vaporization with condensation at a collection region of the separation container. The steam acts as a carrier gas (steam distillation). Other carrier gases can also be used for transport of organic vapor to the collection.

If the separation container is hermetically sealed, reduced system pressures can assist the vapor transportation. The reduced pressures lower the boiling points for the vapors evolved, and vapor transport is sharply increased by boiling.

While vaporization is preferred, in come cases other techniques such as aqueous-organic solvent extraction may also usefully be used.

FIG. 2, Stage 4A: The vaporized organics are condensed and held for further vapor condensation as a result of other techniques.

FIG. 2, Stage 4B: Here material not decomposed by depolymerization is subjected to pyrolysis by heating.

Some pyrolysis is essentially inevitable as corollary to the heating for depolymerization. The depolymerization and pyrolysis in some ways blend into one another: However, the depolymerization refers more to breaking the bonds formed by the original polymerization of reactants, while pyrolysis refers more to breaking miscellaneous bonds, as in charring paper.

FIG. 2, Stage 5: Here carbonaceous material, carrying the hydroxide residues, has now largely altered chemically.

FIG. 2, Stage 6: Material from Stages 4 and 5 may be combined. They move separately or together to monitoring for possible environmental contaminants.

FIG. 2, Stage 8: The nonradioactive organics are monitored. If they pass the monitoring they are ready for release, possibly to recycle and possibly to nonradioactive disposal.

FIG. 2, Stage 9: The radioactive material goes to radioactive disposal in smaller volume than it would have had in current technology.

FIG. 2, Stage 10: The nonradioactive material, in this case free of chemical hazards as well, is disposed of or is recycled.

Figure 3:
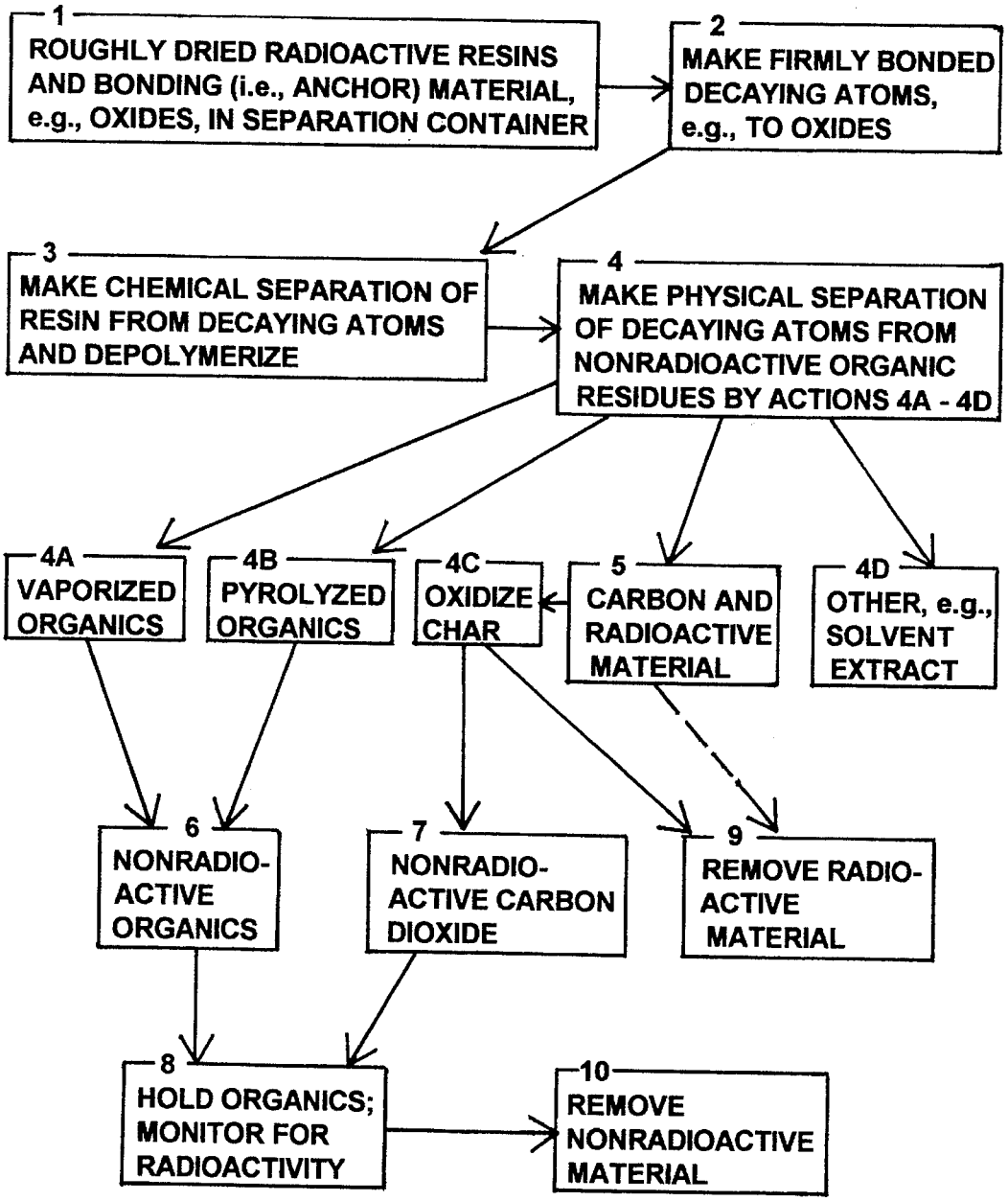
FIG. 3 is an expanded flow diagram with the NaOH-KOH system for preparation of radioactive ion-exchange resin for storage or disposal by burial.

FIG. 3: This figure shows how the essentials of this preferred embodiment in FIG. 2 may be usefully be expanded or altered.

All stages retain their meanings as in FIG. 2. Primarily the stages not included in FIG. 2 are discussed below:

FIG. 3, Stage 4C: The carbonaceous material and decaying atoms which might have moved to disposal may also be oxidized primarily to carbon dioxide, but moisture and other molecules may be released during oxidation.

This oxidation can remove most of the remaining carbon, but inorganics such as oxides, hydroxides, carbonates, sulfates, etc., will remain, holding the decaying atoms.

FIG. 3, Stage 4D: Other techniques may be used instead of vaporization to separate radioactive and nonradioactive portions of the original radioactive ion-exchange resin.

For example, as the material sits after depolymerization and corollary initial polymerization, three regions at least will be present, i.e., a liquid organic phase, a liquid aqueous phase, and solid residuals from the depolymerization.

In effect, a rough solvent extraction already has been achieved by the depolymerization. The separation already may be adequate to provide easy separation of radioactive and nonradioactive materials. Radioactive aqueous liquid can be poured off and dried with radioactive solids then move in small volume to radioactive disposal. And organic liquid decanted before drying off the water can move to nonradioactive disposal.

FIG. 3, Stage 7: Once the larger organic molecules are condensed, nonradioactive carbon dioxide can be collected at another collection site in a separation container. The two sites are not distinguished in the figure but they normally will be separate.

Production of gases such as carbon dioxide should be minimized in early stages of the resin destruction to avoid producing large amounts of gases which are difficult to collect and monitor before they are prepared for disposal.

By conceptual design, residual carbonaceous chars will be in relatively small amounts and may be oxidized to carbon dioxide. This and other gases may be collected and concentrated in several ways, e.g., (i) with cooling at lowered temperatures and at pressures higher than atmospheric, (ii) by low-temperature sorption, (iii) by collection on chemical scrubbers, or (iv) or by combinations of ways.

Carbon dioxide is collected and held in a concentrated form. Therefore, simple analyses can be given enough time and sufficient concentration of decaying atoms to assure accurate measurements. The environmentally benign collected gas can be released to the atmosphere.

Experimental Case 1

A typical case with the preferred embodiment using barium hydroxide anchor material proceeded as follows: First, solid $UF_4$ was contacted for 15 minutes with fresh, sulfonated polystyrene cation-exchange resin in water, thereby adding a distinct $U^{++++}$ color to the resin. Next, the wet resin was mixed with enough $Ba(OH)_2$ anchor material in slurry form to allow ultimate formation of $BaSO_4$ from all the sulfonyl groups in the resin present. This mixture was stirred occasionally for a half hour, allowed to settle, and freed of much of the water by decantation.

The wet mixture of anchor material, radioactive resin, and some solid $UF_4$ was put into a sealed borosilicate-glass system with provision for displacing air, evacuating, heating, and vaporizing and condensing both water and volatile organic materials. The water was largely dried away, either by partial evacuation or by flow of carrier gas, with vapor collection in either case.

Consideration of the experimental behavior and theoretical objectives leads the inventor to conclude that anchoring ions had attached to sulfonyl groups and anchored them. At this point one $Ba^{++}$ attached to two sulfonyl groups, and hydrated barium hydroxide was also present.

Later analyses showed the water to be substantially free of decaying atoms.

The system was further heated toward 300° C., again with partial evacuation or use of argon carrier gas to sweep organic vapors to condensation sites. Fog from vaporization of large organic molecules became increasingly evident as heating proceeded.

It is interpreted that heating in the presence of water and additional anchor ions allows breakage of the anchored sulfonated groups away from the organic portion of the cation-exchange resin: A water molecule replaces the water molecule which was removed during manufacture of the sulfonated resin, giving back a sulfate; also the hydrogen which had been lost in manufacture returns to the resin. These actions leave $BaSO_4$ and, locally, the original polystyrene resin.

The material that vaporized was near totally condensible at room temperature—very little noncondensible material collected in a ballast vacuum chamber.

The condensed vapors were liquid at room temperature, but, after weeks of standing, sometimes show some solid formation due to limited repolymerization.

Unlike ion-exchange resin decompositions with NaOH-KOH anchor (bonding) material, which formed some charry residue, as discussed in Case 2, the $Ba(OH)_2$ anchor material did not yield clear evidence of any carbonaceous residue. Apparently the barium hydroxide provides catalysis for depolymerization of ion-exchange resin that NaOH-KOH does not give.

The resin depolymerization gives the vapor, and the organic material is largely decomposed. Apparently, even the cross-linked material is decomposed more effectively than in Case 2.

The radioactive barium sulfate synthetic barite has not appeared to be wet when the reaction zone is viewed in a borosilicate glass container. Apparently, vaporization largely keeps up with depolymerization. The barite is as crystals which are ghosts of the original ion-exchange resin beads; they are not dusty as they were prepared.

The uranium turned black, coloring the barite, but, as noted, there was no obvious carbonaceous deposit.

The final location of the decaying atoms was all with the unvaporized residue, as well as was detectable with the Eberline beta-gamma counter used.

Experimental Case 2

A typical case with the earlier preferred embodiment using NaOH-KOH bonding material proceeded as follows: Wet cation-exchange resin, $U^{++++}$, and solid NaOH-KOH mixtures were heated in a sealable borosilicate glass operated either with vapor boiling or with sweeping argon gas.

Heating drove off much of the water as vapor, leaving melted hydroxide mixtures with some extra water in solution. A second liquid phase formed from the solid radioactive ion-exchange resin, and vaporization started.

Unlike the condensate with barium hydroxide, as temperatures rose, the heated organic solutions changed both boiling temperatures and colors. Finally, at temperatures approaching 500° C., charry residues remained with the inorganic material, but most of the resin had vaporized.

The separation of radioactive from nonradioactive material was again good, with the radioactive material being with the hydroxides, sulfates, and sulfites, which are not as advantageous for permanent radioactive disposal as barite.

What is claimed is:

1. A method for use in preparation for disposal of radioactive ion-exchange resin that includes decaying atoms and cation exchange resin, comprising the steps of:

a) providing said radioactive ion-exchange resin, b) providing anchor material that can supply anchoring ions that can react at least in part with both said decaying atoms and said cation-exchange resin, c) providing a source of reactant water, d) bringing together said radioactive ion-exchange resin, said anchor material, and said reactant water, thereby e) allowing an initial portion from said anchoring ions to react at least in part with said cation-exchange resin that is included in said radioactive ion-exchange resin, thereby forming anchored cation-exchange groups on first-treated resin, and f) allowing a second portion from said anchoring ions to react at least in part with said decaying atoms, whereby anchored decaying atoms are created, g) supplying energy and a third portion of said anchoring ions at locations where organic/inorganic bonds join carbon atoms of said first-treated resin to said anchored cation-exchange groups on said first treated resin, h) at said organic/inorganic bonds, allowing attachment of additional anchoring ions to said anchored cation-exchange groups, thereby forming firmly bonded radioactive inorganic material that is at least in part chemically freed from carbon atoms that had comprised said first treated resin, thereby i) likewise, forming organic polymer residue that is at least in part chemically freed from said anchored cation-exchange groups, and j) without oxidizing said organic polymer residue, and while supplying energy as needed, carrying out a bulk separation to create both physically separated organic material formed from said organic polymer residue and physically separated, largely inorganic, radioactive material, which may also include remnants of said organic polymer residue.

2. The method of claim 1 in which said anchor material includes a chemical element from the group consisting of Groups IA, IIA, and IIIB of the periodic table.

3. The method of claim 2 in which barium is a chemical element that is supplied.

4. The method of claim 2 in which said anchor material includes hydroxide compounds.

5. The method of claim 1 in which steps g through j are effected in an inert gas.

6. The method of claim 1 in which said supplying energy and a third portion of anchoring ions allows said water to react chemically at said organic/inorganic bonds, thereby allowing effective reversal of the reaction used during manufacture whereby ion-exchange groups were added to the starting resin.

7. The method of claim 1 in which said energy is supplied at least in part by heat.

8. The method of claim 1 in which said energy is supplied at least in part by electromagnetic radiation.

9. The method of claim 1 in which said firmly bonded radioactive material is radioactive synthetic barite.

10. The method of claim 1 in which said decaying atoms coprecipitate at least in part as said firmly bonded radioactive material is forming and precipitating.

11. The method of claim 1 in which said organic polymer residue, including anion-exchange resin that may be present, is depolymerized at least in part prior to said bulk physical separation, thereby forming depolymerized residue.

12. The method of claim 11 in which a compound of barium catalyzes said depolymerization at least in part.

13. The method of claim 11 in which said bulk physical separation is achieved at least in part by vaporization, with corollary transport to condensation elsewhere, of said organic polymer residue, thereby creating vaporization residue and vapor transported organic material.

14. The method of claim 13 in which said vaporization is assisted by vapor transport in flowing inert gas.

15. The method of claim 13 in which said vaporization residue is at least in part further removed by pyrolysis.

16. The method of claim 13 in which said vaporization residue is at least in part further removed by oxidation.

17. The method of claim 1 in which radioactive anions react with organic material while the method of claim 1 is being carried out and are reduced at least in part to cations that react to form firmly bonded radioactive material.

18. The method of claim 1 in which said bulk physical separation is achieved at least in part by filtration that passes material melted by energy supplied for step j of claim 1, and includes at least part of said organic polymer residue while retaining at least 75% of the radioactive material present.

19. The method of claim 1 in which separated organic materials created by said bulk physical separation are retained for radioactive monitoring and possible further decontamination prior to their release to disposal.

20. The method of claim 19 in which radioactive contaminants in said retained organic materials are washed with a phase including water to at least in part free said retained organic materials of said contaminants.

* * * * *